US005427162A

United States Patent [19]

Carter

[11] Patent Number: 5,427,162

[45] Date of Patent: Jun. 27, 1995

[54] WOOD SHAVER

[76] Inventor: Jerry A. Carter, 20162 Spruce Ave., Santa Ana, Calif. 92707

[21] Appl. No.: 218,424

[22] Filed: Mar. 28, 1994

[51] Int. Cl.[6] ..... B27C 9/00; B02C 7/12

[52] U.S. Cl. ..... 144/176; 144/162 R; 144/163; 241/92; 241/278.1; 241/298

[58] Field of Search ..... 144/162 R, 163, 176, 144/369, 373; 241/92, 278.1, 298

[56] References Cited

U.S. PATENT DOCUMENTS

| | | | |
|---|---|---|---|
| 3,542,302 | 11/1970 | Salzmann, Jr. | 241/92 |
| 3,661,329 | 5/1972 | Smith et al. | 241/92 |
| 3,732,907 | 5/1973 | Nystrom et al. | 144/176 |
| 4,159,083 | 6/1979 | Lapointe | 144/162 R |
| 4,184,526 | 1/1980 | Hanaya | 144/176 |
| 4,499,934 | 2/1985 | Rantio | 144/176 |
| 5,076,503 | 12/1991 | Cook | 144/163 |
| 5,261,469 | 11/1993 | Severson | 241/92 |

*Primary Examiner*—W. Donald Bray
*Attorney, Agent, or Firm*—Plante and Strauss

[57] ABSTRACT

There is disclosed a wood shaving device which utilizes a rotating cutting member that supports a plurality of cutting blades which move past a stationary doctor bar. The cutting blades are arranged in a spaced-apart array on the shaving device, lying along non-radial paths so that the predominant action is a successive impact of individual cutting blades, rather than a simultaneous impact of two or more blades against the wood scrap. The cutting blades are preferably supported on a rotating cutting wheel which has a plurality of through apertures, with one each of the cutting blades removably mounted immediately adjacent each through aperture. The cutting blades are rotated past the doctor bar which restricts movement of the wood, resulting in a shaving action on the wood. The wood shavings pass through the through apertures of the cutting wheel and are removed. The wood shaving device includes a hopper with tapered sidewalls and a hydraulic ram that travels along an inclined chute to press the wood scraps into the cutting station. At least one, and preferably two, hydraulically actuated kicker plates are provided to dislodge any wood jams during the operation.

24 Claims, 6 Drawing Sheets

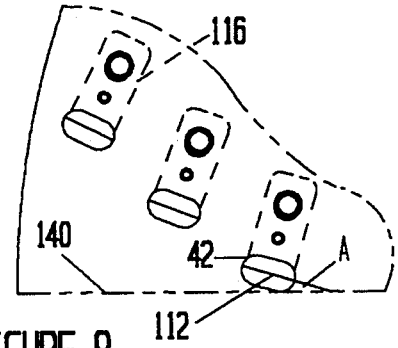
FIGURE 8
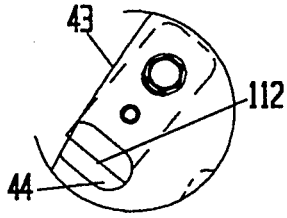
FIGURE 7
FIGURE 9
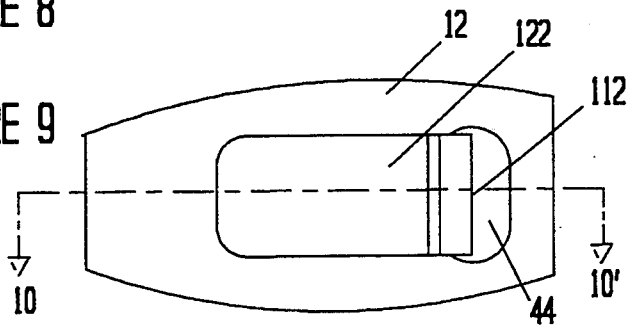
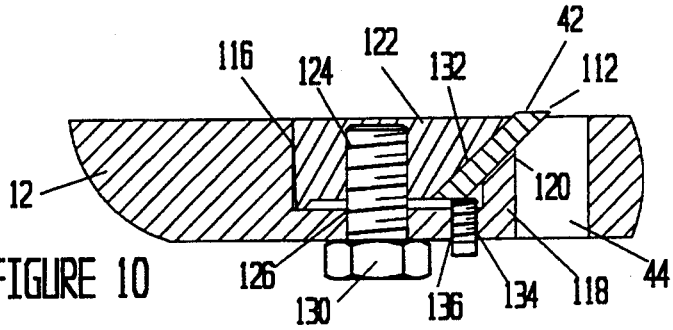
FIGURE 10
FIGURE 11
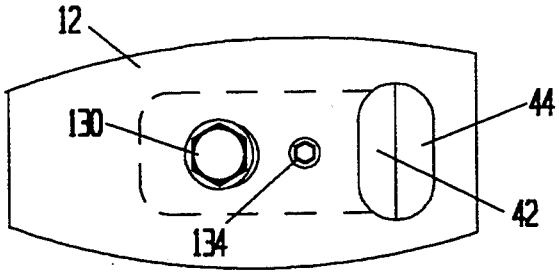

WOOD SHAVER

BACKGROUND OF THE INVENTION

1. This invention relates to a comminuting device and, in particular, to a device for shaving or planning wood, or reducing scrap wood to useful products.

2. Brief Statement of the Prior Art

Various devices have been used for comminuting wood, such as wood scraps, e.g., cut-offs, culls, etc., which are produced by furniture manufacture, building construction, etc. The wood scraps are a desirable source of bedding for animals when they are formed into shavings. Other uses include packing material, potpourri, and soil amendments. The wood scraps can also be used as fuels in commercial furnaces for power generation if comminuted into a usable form.

Various devices have been devised for shredding or shaving wood scraps. Generally, all of these devices suffer from high energy requirements and are subjected to considerable vibration and pounding, resulting in loud noise levels and hazardous operations. Additionally, the prior shaving devices are: difficult to maintain and service, and are not well adapted to handle wood scraps of widely varied shapes and sizes. The comminuting devices currently in use frequently jam, interrupting the operation, and requiring the operator to free the jammed wood scrap. The comminuted products obtained with these devices are solid sticks or pieces of wood, and are not suitable for high value products such as animal bedding or potpourri.

OBJECTIVES OF THE INVENTION

It is an objective of this invention to provide a comminuting device which can be reliably used for reducing wood scraps into useful shapes and sizes.

It is a further objective of this invention to produce a wood shaving device that will produce wood shavings of consistent quality, size and thickness.

It is also an objective of this invention to provide a wood shaving device which is capable of long periods of operation without jams.

It is a further object of this invention to provide an adjustable mounting for cutter blades in a wood shaving device.

Other and related objectives will be apparent from the following description of the invention.

BRIEF STATEMENT OF THE INVENTION

This invention comprises a wood shaving device which utilizes a rotating cutting member, which supports a plurality of cutting blades which move past a radially positioned doctor bar. The cutting blades are arranged in a spaced-apart array on the shaving device, lying along non-radial paths so that the predominant action is a successive impact of individual cutting blades, rather than a simultaneous impact of two or more blades against the wood scrap. The cutting blades are preferably supported on a rotating cutting wheel which has a plurality of through apertures, with one each of the cutting blades removably mounted immediately adjacent each through aperture. The cutting blades are rotated past the doctor bar which restricts movement of the wood, resulting in a shaving action on the wood. The wood shavings pass through the through apertures of the cutting wheel and are removed. The wood shaving device includes a hopper with tapered sidewalls and a hydraulic ram that travels along an inclined chute to press the wood scraps into the cutting station. At least one, and preferably two, hydraulically actuated kicker plates are provided to dislodge any wood jams during the operation.

BRIEF DESCRIPTION OF THE DRAWINGS

The invention will be described with reference to the FIGURES, of which;

FIG. 7 is an enlarged view of the area within line 7–7' of FIG. 6;

FIG. 8 is an enlarged view of a portion of a cutting wheel of an alternative embodiment;

FIG. 9 is an enlarged view of a cutter on the cutting side of the cutting wheel used in the invention;

FIG. 10 is a sectional view along lines 10–10' of FIG. 9; and

FIG. 11 is a view of the cutter on the discharge side of the cutting wheel used in the invention.

DESCRIPTION OF PREFERRED EMBODIMENT

Figure 1:
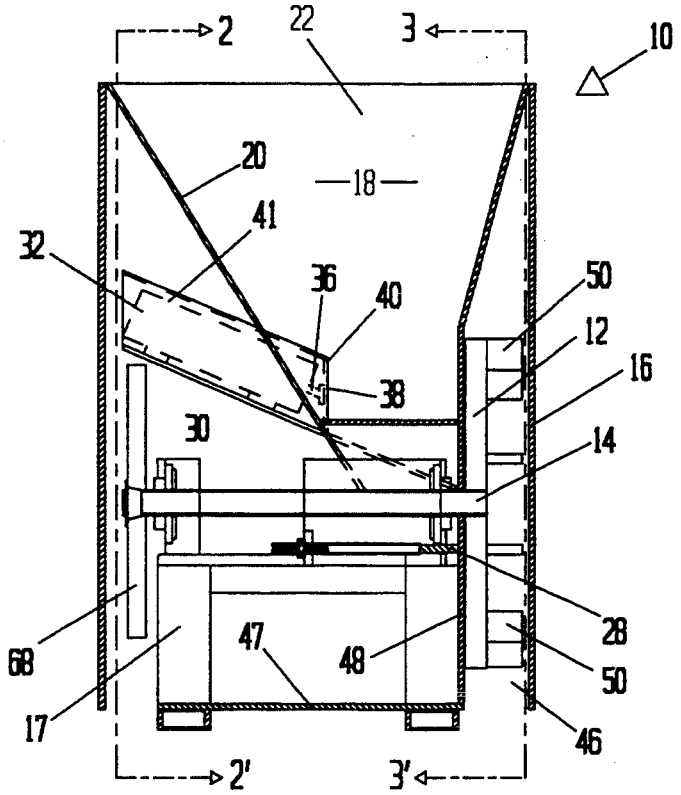
FIG. 1 is an elevational partial sectional side view of the shaving device along line 1–1' of FIG. 2.

Referring to FIGS. 1–4, the wood shaving device 10 of the invention utilizes a rotating member 12 which can be a drum or wheel. Preferably a wheel 12 is employed. The cutting wheel 12 is mounted on a shaft 14 supported on the mainframe 17 of the device, within a comminuting housing 16, which is formed of sheet metal side and top panels, also supported by the mainframe. The electrical drive motor 60 is mounted on the bottom frame 47 of the housing 16 and is connected to the shaft 14 by a drive pulley 64, belts 66 and driven pulley 68 which is secured to the drive shaft 14. The wheel 12 supports cutting knifes which are not shown in FIGS. 1–4, but which are shown in FIGS. 5–9.

The housing 16 is generally rectangular in cross section and has a hopper 18 in its upper section. The hopper 18 is formed with an inclined side wall 20 (see FIG. 1), and an inclined side wall 22 which extends over the support shaft 14 for the cutting wheel 12. At the base of the hopper 18 and immediately adjacent the cutting face,26 of the wheel 12 (see FIG. 1) a doctor bar 28 is adjustably mounted in the assembly. This doctor bar 28 forms a stationary anvil that prevents passage of the wood scraps so that they are shaved by the cutters on the cutting wheel.

Figure 2:
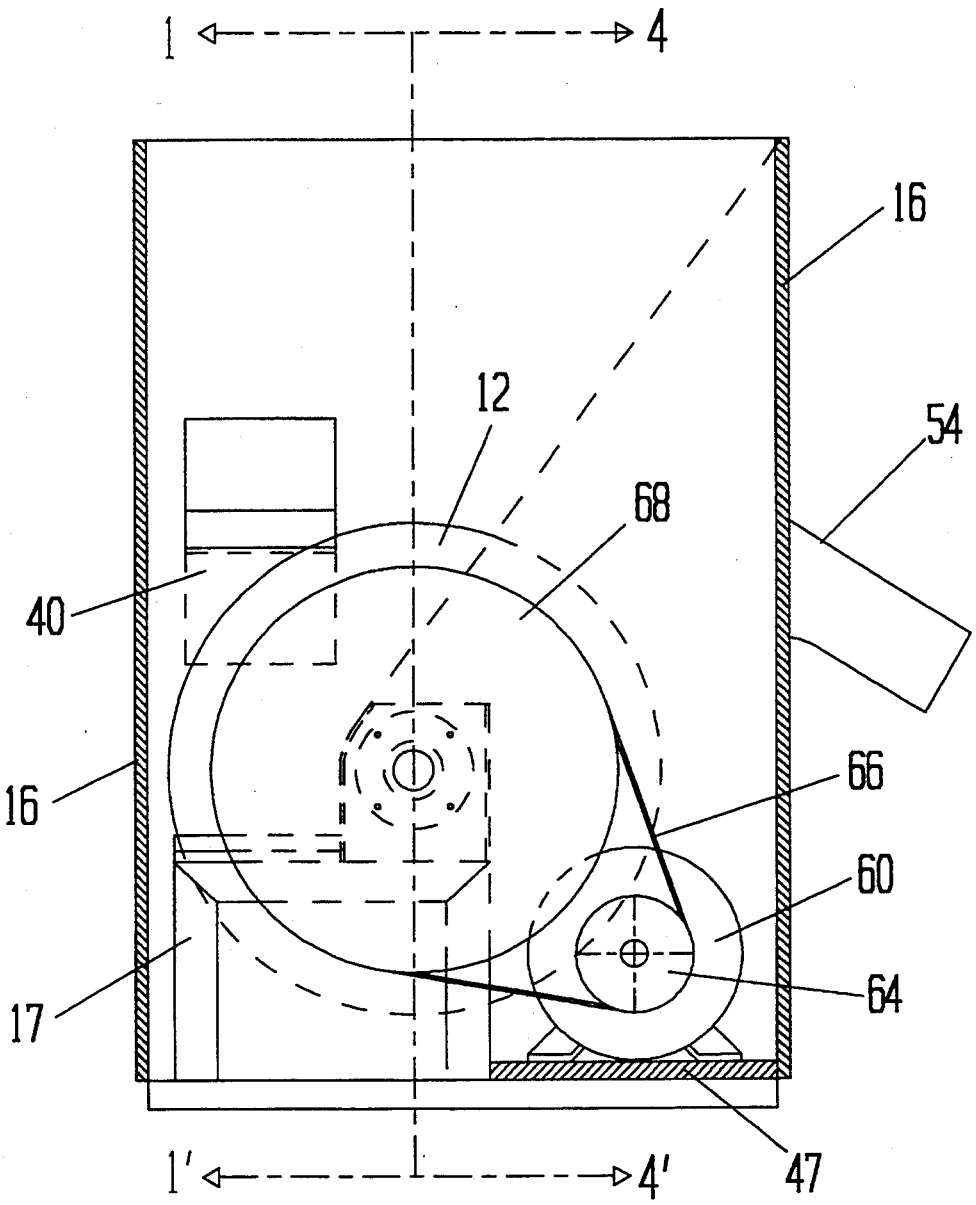
FIG. 2 is an elevational sectional view of the front of the shaving device of the invention along line 2–2' of FIG. 1.

As shown in FIGS. 1 and 2, the front wall 20 of the hopper is opposite the cutting wheel is intersected by an inclined feed ramp 30 which extends to the doctor bar 28. A hydraulic cylinder 32 is permanently mounted on the feed ramp 30, mostly outside of the hopper 18. The end of the piston rod 36 of the hydraulic cylinder extends into attachment to a feed ram 38 which has a vertical ram plate 40 and a rearwardly extending ram housing 41, which in its retracted position shown in FIG. 1 surrounds the hydraulic cylinder 32. The piston rod 36 of the hydraulic cylinder 32 advances the ram 38 towards the surface of the wheel, stopping short of contacting the wheel at full extension, thereby serving to forcefully direct the wood scraps down the feed ramp 30 and against the rotating cutter wheel 12, orienting the wood scraps vertically so that the cutting action is along the grain of the wood.

Figure 6:
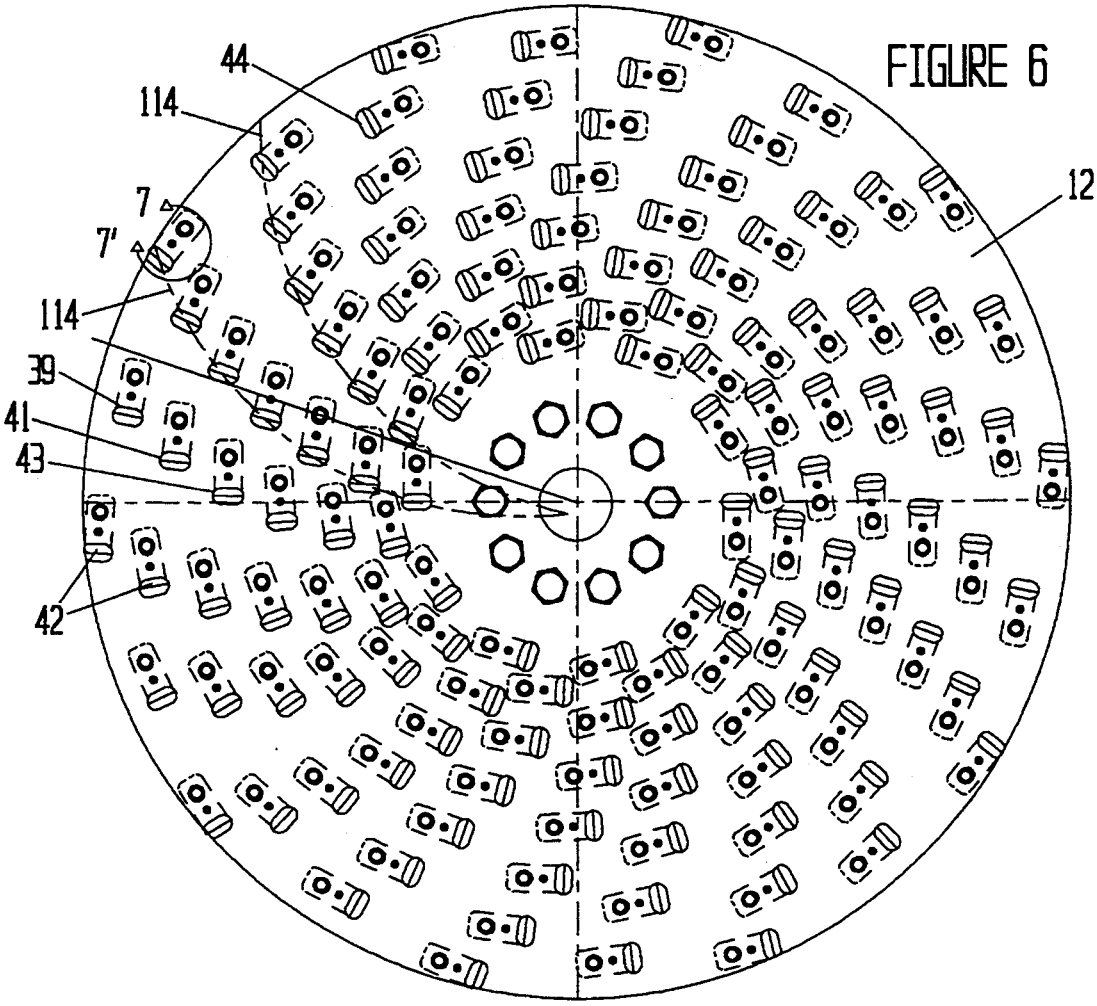
FIG. 6 is a plan view of the preferred cutting wheel used in the wood shaving device of the invention.

The cutting wheel 12 is shown in FIG. 6, which is a view from the back side of the wheel 12. The wheel 12 has a plurality of cutter blades 42. Each of the cutter blades 42 is immediately adjacent a through aperture 44. As shown in greater detail in FIGS. 7–11, each through aperture 44 is a slot which is coextensive with, and slightly wider than the width of the cutter blade 42.

The outboard row of cutting blades 42 is located on the cutting wheel 12 to project slightly beyond the outer periphery of the wheel, as apparent from the illustration of FIG. 7. As there illustrated, the through aperture slot 44 is open to the peripheral sidewall of the wheel and the cutting blade projects a slight distance, typically from about 0.005 to about 0.025 inch beyond the circumference of the wheel 12. It has been found that this substantially reduces the tendency of wood scraps to jam in the wood shaving device.

Figure 3:
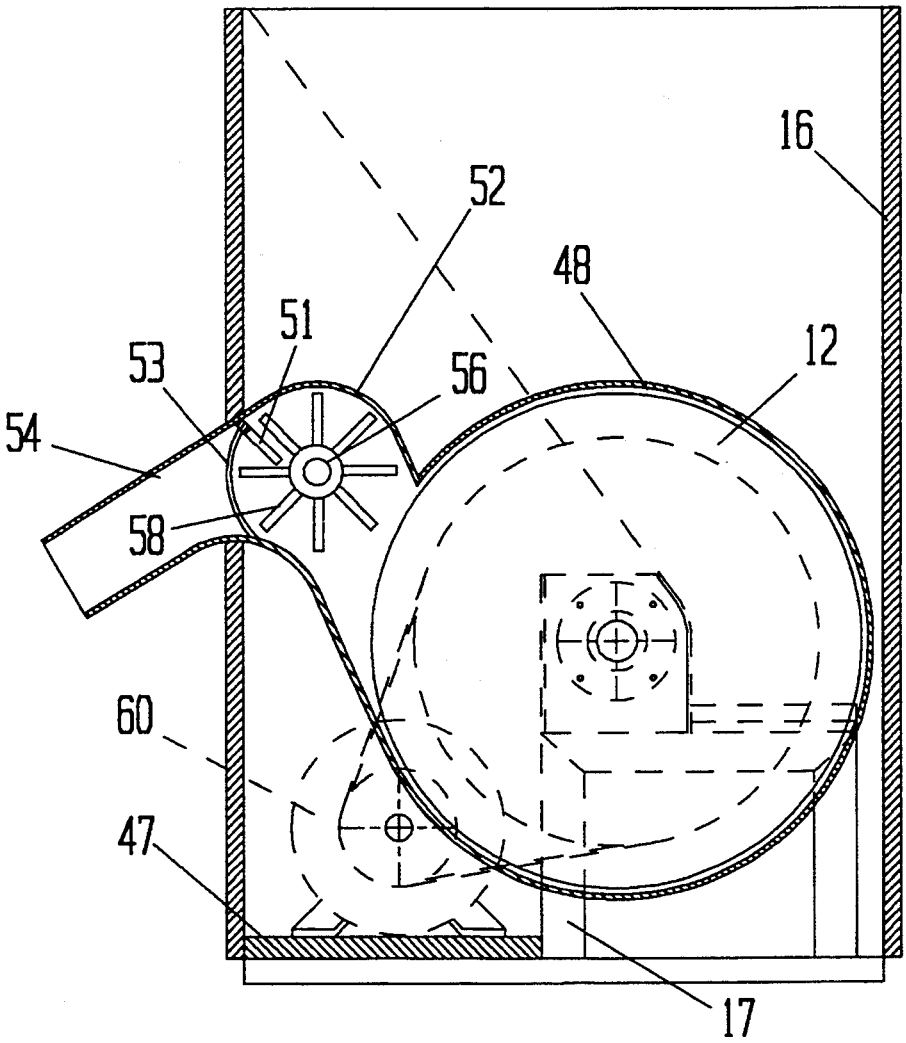
FIG. 3 is an elevational sectional view of the rear of the shaving device of the invention along line 3–3' of FIG. 1.
Figure 4:
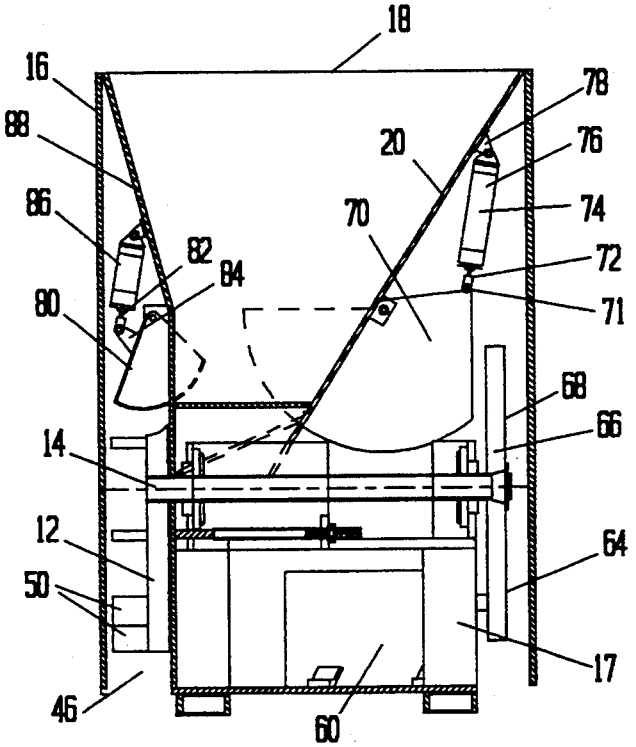
FIG. 4 is an elevational sectional view of the side of the wood shaving device of the invention along line 4–4' of FIG. 2.

Referring now to FIGS. 1, 3 and 4, wood shavings which are formed by the cutter blades 42 pass through the apertures 44 of the wheel, exiting the hopper and discharging into a removal section 46 that is enclosed by a shroud 48 which extends about the cutting wheel 12. The cutting wheel has a plurality of fan blades 50 on its backside, disposed at equal angular spacings about the outer periphery of the wheel, e.g., ten fan blades can be spaced at 36 degree angular increments. The shroud 48 opens into a duct 52 with an angularly offset neck 54. A secondary comminuting device, such as a shredder wheel 56 is rotationally mounted in the duct 52 and has a plurality of blades 58 to reduce the size of the shavings, if desired. The shredder wheel 56 is driven by its own electrical motor, not shown. If desired, a plurality of stationary blades 51 can be interspaced between the blades 58 to improve the shredding action, and sizing screens 53 can be placed at the opening to the discharge chute: 54 to control the maximum particle size. Any oversized particles are deflected by the screen 53 back into the shroud 48 to be reprocessed by the shredder wheel 56.

The wood shavings are discharged from the neck 54 into suitable storage facilities, e.g., a hopper, bags or other containers, or transferred to a material handling device such as a conveyor, auger, etc.

Referring now to FIG. 4, a plurality of kicker plates are used to prevent jamming of the irregularly sized wood scraps in the hopper. A large kicker plate 70 is pivotally mounted on inclined front wall 20 of hopper 18. This kicker plate 70 has a tab 71 which is apertured to receive a fastener coupling to the end of a piston rod 72 of a hydraulic cylinder 74. The opposite end 76 of the hydraulic cylinder 74 is pivotally supported by a bracket 78 on the undersurface of the front wall 20 of the hopper 18, thereby providing an articulated connection which, upon extension of the piston rod 72, forces the kicker plate 70 into the hopper 18 to the extended position shown by the broken lines.

Preferably, a second and smaller kicker panel 80 is pivotally supported on the upper portion of sidewall 22 of the hopper 18. The upper portion of the wheel 12 is cut away in the view of FIG. 4, to provide a clear view of panel 80. The kicker panel 80 also has a tab 82 which is pivotally attached to the piston rod 84 of a second hydraulic cylinder 86 that is pivotally supported on the outside of the rear wall 88 of the hopper. The actuation of the hydraulic cylinder 86 will project the kicker panel 80 into the hopper, dislodging any wood scraps in its path.

Figure 5:
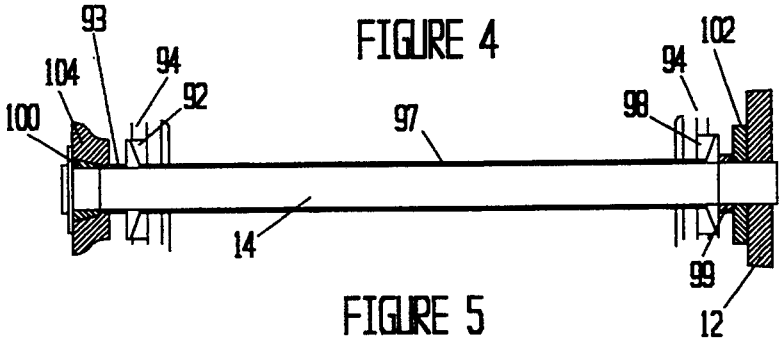
FIG. 5 is a an enlarged sectional view of the main shaft of the wood shaving device of the invention.

The cutting wheel 12 is rotationally mounted on the comminuter mainframe 17 on a drive shaft 14 that extends across the housing. As shown in FIG. 5, the drive shaft 14 for the cutting wheel is mounted on bearings 92 and 98 carried by support brackets that are fixedly mounted on a pair of brackets 94 on opposite sides of the comminuter housing. The drive shaft 14 is received within a thrust sleeve 93 and is distally supported by a bearings 92 and 98 that bear against the thrust sleeve 97. The thrust sleeve 97 is axially restrained by the taper lock bushing 100 in the hub of the driven pulley 104. The drive shaft 14 is fixedly secured to the hub 102 of the cutter wheel 12. The negative thrust is transmitted through the drive shaft 14 to the taper lock bushing 100 and back through thrust sleeve 97, the inner race of bearing 92 and through sleeve 97 into the double tapered roller bearing 98. Sleeve 99 is used to axially retain the hub position relative to bearing 98. In this fashion axial thrusts on the cutter wheel are absorbed by the tapered thrust bearings.

At its opposite end, the shaft 14 supports the drive pulley 68. The drive pulley 68 is linked with an endless belt 66 to the output drive pulley 64 of the drive motor 60 which is mounted on plate 47 which is supported on the mainframe 17 of the device.

The cutter blades 42 are mounted on the cutting wheel 12 in the array which is illustrated in FIG. 6. As there illustrated, each cutter of the cutting wheel has a cutter blade 42 (see FIG. 4) which is positioned to span across a slot 44 that constitutes a through aperture in the cutting wheel 12. Each blade 42 as described hereinafter, is removably and adjustable fixed in the cutting wheel 12 with its cutting edge 112 extending across the through aperture slot 44. As apparent from FIG. 6, the cutting blades are arrayed in an alignment which does not lie on any common radial of the wheel. In this manner, each of the cutting blades 42 will successively impact the wood scraps, thus providing a continuous sequence of closely time-spaced impacts, rather than a single massive impact which would be experienced if the cutting blades 42 were aligned on radials of the cutting wheel. Preferably, each array of cutting blades is aligned on a helical path 114 which is illustrated in FIG. 6.

Each of the blades 42 is removably and adjustable supported in the assembly. FIGS. 9–11 illustrate the blade mounting assembly. As shown in FIG. 9, the wheel 12 has through apertures in the form of elongated slots 44. Each slot 44 is contiguous with a recess 116 in the cutting face of the wheel. Preferably the recess 116 is a generally rectangular pocket orthogonal to the elongated through slot 44. The recess 116 is separated from the slot, at its lower portion, by a wall 118 having an inclined upper edge 120. The wall 118 serves as a support for the knife 42 which is a rectangular blade having a cutting edge 112. The blade 42 rests on the inclined upper edge 120 of the intermediate wall 118 and is fixedly secured in place by a knife clamp block 122 that seats in the recess 116. The clamp block 122 has a central threaded aperture 124 which aligns with a through aperture 126 in the bottom wall 128 of the recess 116 and a lock screw 130 is extended through the aperture 126 and into engagement in the threaded aperture 124 of the clamp block 122 thereby permitting the clamp block to be compressed against the blade 42, securing the blade in its desired position. The clamp block 122 has an inclined face 132 which rests against the surface of the cutting blade 42, compressing the cutting blade and fixedly securing it. At its opposite end 117, the side wall of the clamp block 122 is chamfered slightly, e.g., up to about 5 degrees (2 degrees shown) to allow for full compressive force to be applied to the blade 42. A height adjustment screw 134 is provided in a threaded aperture 136 in the bottom wall of the recess 116 and the advance or retraction of screw 134 raises and lowers the cutting blade 42 in the assembly. The height of the blade above the surface of the cutting wheel can be fixedly adjusted from 0.0 to about 0.25 inch, and commonly is set at about 0.005 to 0.025 inch, thereby producing wood shavings which are well suited as pet and horse bedding.

Although the blades are shown with their cutting edges lying on radials of the cutting wheel, it is apparent that they can be skewed, or tilted from this alignment. Tilting of the blades in planing and shaving devices has the effect of changing the attack angle of the blades and decreases the cutting force required. The same benefit can be achieved by tilting the blades of the wood shaving device of this invention by an angle up to 45 degrees, if desired. An example of a tilted blade is shown in FIG. 8, in which the cutting edge 112 of the blade 42 is tilted an angle A from the radial 140. The pocket 116 is machined in wheel 12 at the same angle A. The angle A is illustrated as 30 degrees, however in can be at any angle from 5 to 45 degrees, if desired.

The blades 42 can be serviced from the back side of the cutting wheel 12 by loosening of the lock screw 130 in the clamp block 122 and advancing or retracting of the height adjustment screw 134.

The operation of the wood shaving device is preferably automated by timing and other control circuits. The woods scamps are discharged into hopper 18 by a belt or chain conveyor which receives the wood scraps from a supply hopper. The conveyor is operated by a timer circuit and moves a pre-set distance or travel and then stops. The hydraulic cylinder simultaneously advances the feed ram forward, forcing wood scraps in the hopper against the cutting face of the wheel 12.

The electrical power to the drive motor 60 is monitored and when the power reaches a pre-set value, the ram and conveyor are stopped. After the power reduces to an acceptable level, the hydraulic supply to the feed ram cylinder is restored and the ram continues forward unless stopped again. In the event of a jam at the cutter wheel, the feed ram goes through three successive attempts to reactivate, and then the control circuit sounds an audible alarm and shuts down the device.

The kicker plates 70 and 80 are activated periodically during operation, insuring that larger wood scraps do not jam in the hopper.

Once the ram reaches full travel, the hydraulic supply to the ram cylinder is reversed, retracting the ram. The hydraulic supply automatically reverses when the ram is withdrawn to return the ram to its forward travel.

In a typical embodiment a wood shaving device with a 37 inch diameter wheel with 130 cutters disposed in the spaced-apart array shown in FIG. 6 is driven with a 75 horsepower electrical motor at about 600 revolutions per minute. The knife blades are adjusted to provide an elevation of 0.02 inch above the surface of cutting wheel. The wood shaving device is used to produce wood shavings from a mix of soft redwood, pine and red oak wood scraps having maximum width and thickness of 12 by 12 inches. The length is unlimited, and only depends on the wood scrap feeding conveyor used to introduce the wood into the device. The wood shaving device readily handles about 5 cubic yards of wood scraps per hour, and produces wood shavings having a volume approximately 2.5 to 3 times the volume of the wood fed to the device.

The invention thus provides a wood shaving device having a rotatable cutting member which supports removable and adjustable knives that arranged in an array on the cutting surface of the cutting member which does not lie along a common linear path on the cutting surface, thereby avoiding the simultaneous impacting of more than a single cutting blade against a workpiece. The wood shaving device is provided with an automatic feed ram and with remotely actuated kicker plates that dislodge any jams of the wood scraps pieces, ensuring continuous and uninterrupted operation.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A wood shaving device which includes a cutting station and delivery means to deliver wood to said cutting station, which comprises:

a. a cutting station having a planar cutter wheel mounted on a shaft which is rotatably supported on a support frame, which wheel supports a plurality of cutters disposed in a spaced array across its planar cutting face, each cutter comprising a through aperture in said wheel, a pocket in said planar cutting face adjacent to and intersecting said through aperture, a support wall between said pocket and said aperture, said support wall having a bevelled upper edge, a cutting blade fixedly secured with its cutting edge extending across said through aperture in said cutting wheel and resting on said bevelled upper edge of said support wall, a blade clamp within said pocket and secured therein by means to clamp said blade against said bevelled edge of said support wall and thereby fixedly secure said blade in said pocket.

2. The wood shaving device of claim 1 wherein said spaced apart arrays of said cutters lie along curvilinear paths.

3. The wood shaving device of claim 2 wherein said curvilinear paths are helical paths.

4. The wood shaving device of claim 1 wherein a plurality of cutters are located at the periphery of said wheel, in positions with the cutter blade of each cutter extending a slight distance beyond the outer periphery of said wheel.

5. The wood shaving device of claim 1 wherein each of the apertures of said cutters is an elongated slot having a long side and a short side, and wherein each of said blades is positioned with its cutting blade extending across its respective elongated slot, with its cutting edge parallel to said long side of said elongated slot.

6. The wood shaving device of claim. 1 wherein said means to compress said blade comprises a threaded bore in each of said blade clamps and an oversized hole in the bottom wall of each of said pockets, in alignment with said threaded bore, and a lock screw received through said oversized hole and in said threaded bore.

7. The wood shaving device of claim 6 including a plurality of adjustable means to position the elevation of the cutting edge of each of said blades above the cutting face of said wheel.

8. The wood shaving device of claim 7 wherein each of said adjustable means is a threaded bore in the bottom wall of said pocket and a set screw received therein with its upper end providing an adjustable stop for the bottom edge of its respective cutting blade.

9. The wood shaving device of claim 1 including a thrust sleeve coaxially received over said drive shaft and axially interlocked to said drive shaft, and including thrust bearing means carried on said frame to absorb axial thrust loads from said drive shaft.

10. A wood shaving device for comminuting solids which includes a cutting station having a cutter wheel that supports a plurality of cutters disposed in a spaced array across its cutting face, each cutter comprising a cutting blade fixedly secured with its cutting edge extending across an adjacent through aperture in said cutting wheel for passage of solid cuttings therethrough, said cutting wheel being mounted on a drive shaft for rotational movement of its cutting face past said cutting station, a stationary workpiece support at said cutting station adjacent the cutting face of said wheel, and a wood delivery system comprising a hopper having four side walls, with the side wall adjacent said cutting wheel being substantially vertical, and a first inwardly inclined side wall which is opposite said substantially vertical wall and an inclined feed ramp which intersects said inwardly inclined side wall and which extends to said workpiece support, and including feed ram means slidably received on said inclined feed ramp with means to advance said ram means towards, and retract said feed ram means from, said workpiece support.

11. The wood shaving device of claim 10 including a kicker plate orthogonal to, and pivotally mounted on said first inwardly inclined side wall and including an actuator to pivot said kicker plate into said hopper and to retract it therefrom.

12. The wood shaving device of claim 11 including a second kicker plate orthogonal to, and pivotally mounted on said substantially vertical side wall and including a second actuator to pivot said second kicker plate into said hopper and to retract it therefrom.

13. The wood shaving device of claim 10 wherein another of said side walls is inclined downwardly and extends coextensively along said first inwardly inclined side wall.

14. The wood shaving device of claim 1 including a shroud surrounding said cutting wheel on the underside of said hopper, and a cuttings discharge chute open thereto and tangentially located on said shroud.

15. A wood shaving device for comminuting solids which includes a cutting station and wood delivery means to deliver solids to said cutting station, the improvement comprising a cutting station having a cutter wheel that supports a plurality of cutters disposed in a spaced array across its cutting face, each cutter comprising a cutting blade fixedly secured with its cutting edge extending across an adjacent through aperture in said cutting wheel for passage of solid cuttings therethrough, said cutting wheel being mounted on a drive shaft for rotational movement of its cutting face past said cutting station, said spaced array of said cutters lying along non-radial paths, a shroud surrounding said cutting wheel on the underside of said hopper, a cuttings discharge chute open thereto and tangentially located on said shroud and attrition means located within said chute to receive and comminute cuttings received from said cutting wheel.

16. The wood shaving device of claim 15 wherein said attrition means comprises a plurality of blades in a spaced apart stacked array which are rotationally mounted on a shaft carried on said frame.

17. The wood shaving device of claim 16 including a plurality of stationary blades, also in a spaced apart stacked array and located beside, and intermeshed with, said first plurality of blades.

18. The wood shaving device of claim 1 wherein each of said cutting blades is disposed at an angle up to 45 degrees to the respective radial of said wheel intersecting said blade.

19. In a wood shaving device for comminuting solids which includes a cutting station and wood delivery means to deliver solids to said cutting station, the improvement comprising a cutting station having a cutter wheel with a planar cutting face that supports a plurality of cutters disposed across its cutting face in a spaced array, each cutter comprising a cutting blade fixedly secured with its cutting edge parallel to said planar cutting face at a distance from 0.005 to 0.025 inch above said face, and extending across an adjacent through aperture in said cutting wheel for passage of solid cuttings therethrough, said cutting wheel being mounted on a drive shaft for rotational movement of its cutting face past said cutting station, the improvement which comprises: each of said cutting blades being disposed at an angle from 5 to about 45 degrees to the respective radial of said wheel intersecting said blade.

20. The wood shaving device of claim 19 wherein said spaced array of said cutters lie along non-radial paths.

21. The wood shaving device of claim 20 wherein said spaced apart arrays of said cutters lie along curvilinear paths.

22. The wood shaving device of claim 21 wherein said curvilinear paths are helical paths.

23. The wood shaving device of claim 19 wherein a plurality of cutters are located at the periphery of said wheel, in positions with the cutter blade of each cutter extending a slight distance beyond the outer periphery of said wheel.

24. The wood shaving device of claim 19 wherein each of the apertures of said cutters is an elongated slot and wherein each of said blades is positioned with its cutting blade extending across its respective elongated slot, with its cutting edge parallel to long sides of said elongated slot.

* * * * *